US005593555A

United States Patent [19]

Klatt et al.

[11] Patent Number: 5,593,555

[45] Date of Patent: Jan. 14, 1997

[54] ELECTRODE STRUCTURE FOR A MONOPOLAR ELECTROLYSIS CELL OPERATING BY THE DIAPHRAGM OR MEMBRANE PROCESS

[75] Inventors: Bruno Klatt; Günter Kreutzberger, both of Wolfen; Manfred Suchi, Bitterfeld, all of Germany

[73] Assignee: Heraeus Electrochemie Bitterfeld GmbH, Bitterfeld, Germany

[21] Appl. No.: 446,045

[22] Filed: May 19, 1995

[30] Foreign Application Priority Data

Jun. 1, 1994 [DE] Germany ..... 44 19 091.3

[51] Int. Cl.[6] ..... C25B 11/00

[52] U.S. Cl. ..... 204/286; 204/280; 204/284

[58] Field of Search ..... 204/280, 286, 204/284

[56] References Cited

U.S. PATENT DOCUMENTS 4,033,849 7/1977 Pohto et al. ..... 204/286

4,448,664 5/1984 Ikegami et al. ..... 204/286

FOREIGN PATENT DOCUMENTS 611836 8/1994 European Pat. Off. .

2124257 2/1984 United Kingdom .

*Primary Examiner*—Bruce F. Bell

*Attorney, Agent, or Firm*—Felfe & Lynch

[57] ABSTRACT

In a monopolar electrolysis cell for chlor-alkali electrolysis by the diaphragm or membrane process, the cathodic and anodic electrode structures extend in the vertical direction, the anodic structure being surrounded by the cathodic electrode structure. In the area of the active electrode surfaces, an upward-directed flow of electrolyte-gas mixture is produced as a result of the gas bubbles generated electrolytically in the electrode gap, whereupon the electrolyte is then degassed. The degassed electrolyte, because of its higher specific gravity, then flows down through a flow channel inside the anodic electrode structure, this channel being formed by vertically oriented feed conductors and U-shaped flow guide plates.

3 Claims, 4 Drawing Sheets

ELECTRODE STRUCTURE FOR A MONOPOLAR ELECTROLYSIS CELL OPERATING BY THE DIAPHRAGM OR MEMBRANE PROCESS

Background of the Invention

The invention pertains to an electrode structure for a monopolar electrolysis cell for chlor-alkali electrolysis by the diaphragm or membrane cell process with electrodes oriented in essentially the vertical direction with lateral openings; the electrodes, seen in the direction of the vertical axis, being designed as open structures; a flow guide for the recirculating electrolyte being provided in the anodic electrode structure; this guide also serves as the main power feed.

An electrolysis cell for chlor-alkali electrolysis by the diaphragm or membrane process is known from EP-A 383,243, in which the anodes, which extend essentially in the vertical direction, appear as open structures when seen in the direction of the vertical axis. Flow guide elements are provided to promote the upward circulation of anolyte-gas mixture and the downward motion of gas-free anolyte. The main power feed is installed in the interior of the anode, which consists of two parts assembled to form a box-like structure, and is connected by way of current feed plates extending in the form of an X in the radial direction to the anodically active surface of the electrode. The cathode enclosing the anode structure is surrounded in a pocket-like manner by a diaphragm.

It turned out to be a problem with this design that only the cylindrical flow channel in the interior cavity is available for the return of the degassed anolyte. The remaining free cross section of the anode structure is intended for the upward-directed flow of the anolyte-gas mixture. Thus, an unfavorable ratio is obtained between the two cross-sectional areas available for the upward and downward flows.

SUMMARY OF THE INVENTION

The invention is based on the task of improving the return of the degassed anolyte to the active surfaces of the anode by making available a flow cross section extending across the X-shaped feed conductors. This task is accomplished by providing a closed vertical flow channel having an electrode structure fixed to its outside surfaces. The flow channel is formed by a conductive channel member having a U-shaped cross-section fixed to a vertical power feed. The channel member comprises a pair of panel-like feed conductors extending from the power feed in vertical planes. A flow guide plate having a U-shaped cross-section has distal ends which engage distal ends of the feed conductors to form the closed channel.

The essential advantage of the invention is to be seen in the fact that the return flow channel of the anode extends over almost the entire width of the anode, which results in a better distribution of the gas bubble-free anolyte in the lower part of the anode. It also turns out to be advantageous, furthermore, that components of existing anode designs currently in use can be conveniently utilized, which means that already existing electrolysis cells can be converted to the new design. The guide plates which support the jacket-like outer electrode structure also provide additional mechanical stabilization of the anode structure.

In a preferred embodiment of the invention, the main power feed is connected at its outer periphery by means of a single, continuous weld or by a series of spot welds extending in the vertical direction to the feed conductors, which extend toward the interior surfaces of the outer electrode surrounding the main power feed in a box-like manner. At that point, for the purpose of supplying power and establishing mechanical connection, the conductors are welded to the inside surface of the flat electrode structure. The feed conductors have vertical detents in the area where they are connected to the outer electrode structure; these detents cooperate with the congruently designed ends of the flow guide plates to fix the feed conductors and guide plates as an assembly.

In a preferred embodiment, it has been found that the absence of flow guide plates outside the outer anode structure is advantageous. This means in particular that already existing systems can be easily reconfigured.

DETAILED DESCRIPTION OF THE PREFERRED EMBODIMENTS

Figure 1:
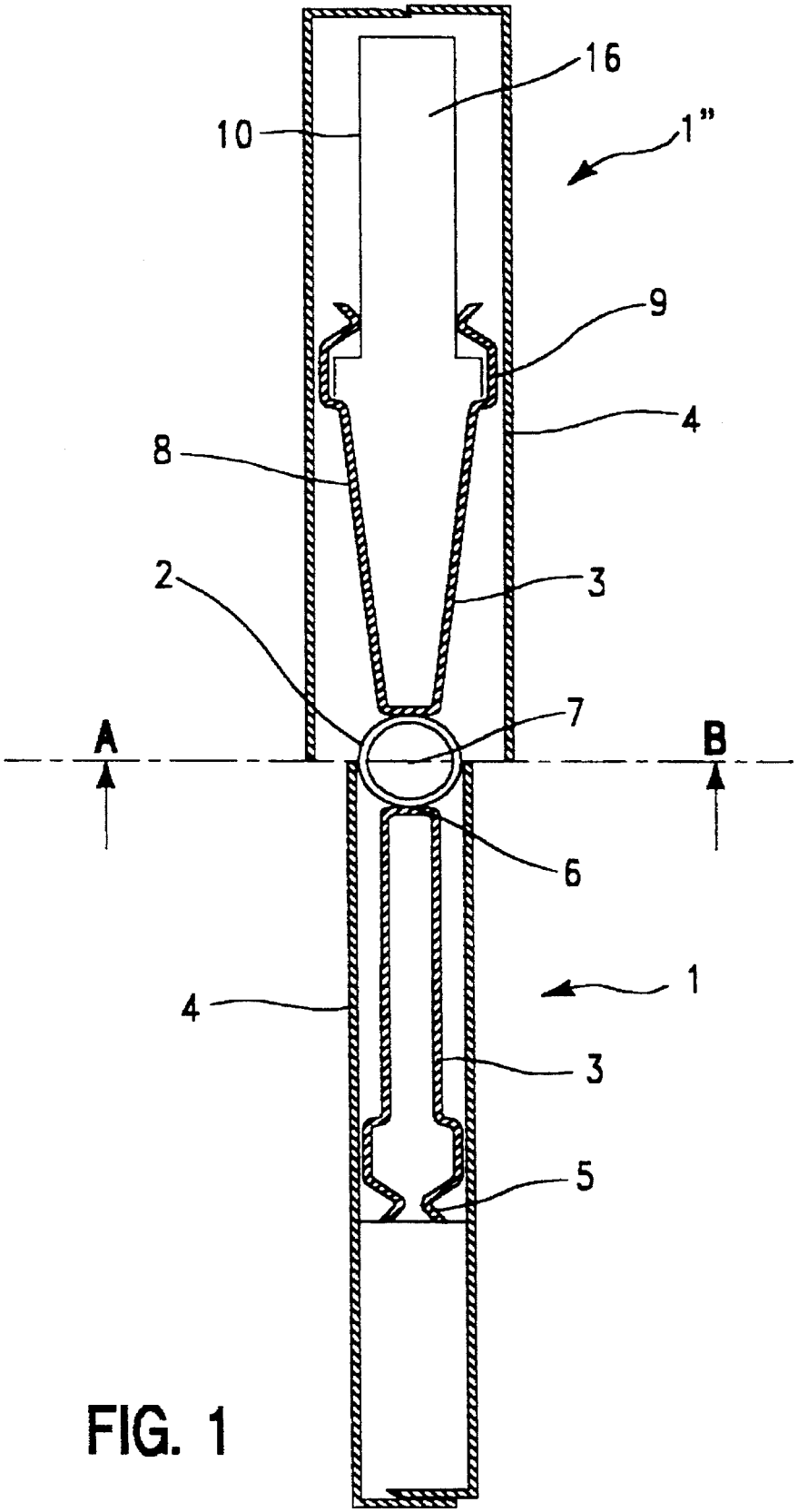
FIG. 1 is a schematic cross section of an electrode structure which is designed to accept a flow guide plate, wherein the lower half has not yet been expanded and the upper half is expanded and provided with a flow guide plate.

FIG. 1 shows a schematic diagram of an electrode structure 1. Below the axis of symmetry designated AB, the electrode structure is in the unexpanded state and is referred to by reference number 1', whereas electrode structure 1" illustrated above the axis of symmetry is shown in the expanded state.

Electrode structure 1' shown in cross section consists of a main power feed 2, a feed conductor 3, and active electrode surfaces 4. Feed conductor 3 consists of a metal plate, which is bent into the shape of a U or V, and which is connected by U-shaped folded or bent areas 5 to active electrode surfaces 4 by welding. Because the view is cross-sectional, looking in the direction of the vertical axis, weld 6 extends parallel to axis 7 of main power feed 2. In the area of its shanks 8, projecting to form the shape of a U or V, feed conductor 3 is connected by welds to U-shaped or box-like active electrode surfaces 4; welds 9 also extend parallel to axis 7 of main power feed 2. Near their outer edges, the shanks 8 of feed conductors 3 have detents, which serve to retain U-shaped flow guide plates 10 which form a flow channel 16 parallel to axis 7 of the main power feed in the area of electrode structure 1". The U-shaped flow plates 10 can, after the expansion of the electrode structure, be pushed in and locked in place parallel to axis 7 of the main power feed.

Figure 2:
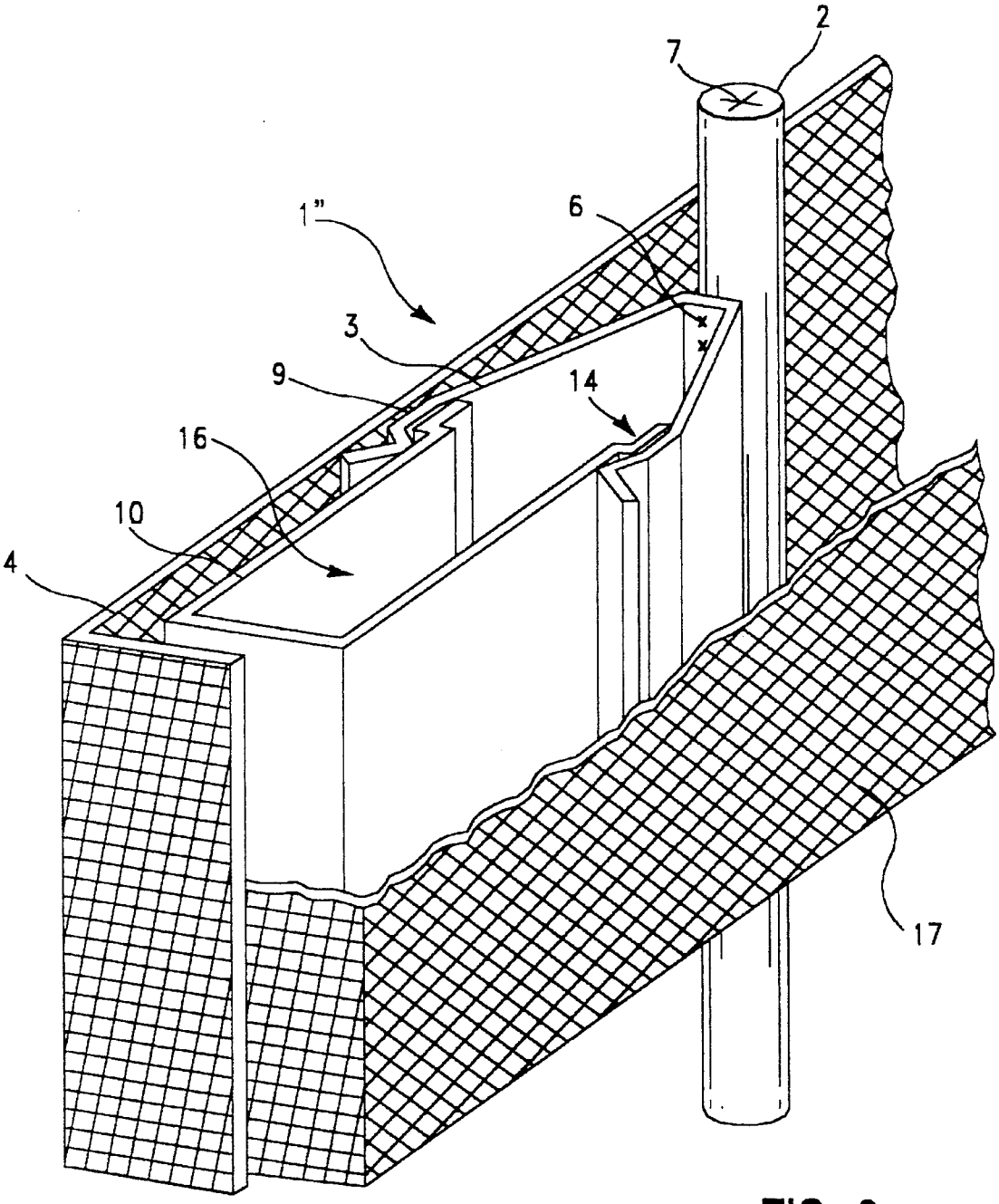
FIG. 2 is a cut away perspective view of an electrode structure with an inserted flow guide plate.

FIG. 2 shows a partially cut-away, perspective view of an expanded electrode structure 1", in which active electrode surfaces 4 consist of expanded metal and are connected by means of welds 9 to U-shaped feed conductors 3, which are in turn connected by welds 6 to main power feed 2. Parallel to weld 9 of feed conductor 3 there is a recess, which is used to accept a flow guide plate 10, also in the shape of a U. The distal ends 14 of flow guide plate 10 are designed as detents which can be pushed in along axis 7 of feed conductor 2 to establish a positive connection between feed conductor 3 and flow guide plate 10. The interior space enclosed by feed conductor 3 and flow guide plate 10 is referred as flow channel 16. For the sake of illustration, part of the electrode structure 17 is shown cut away, so that the main power feed 2, the feed conductors 3, and the flow guide plate 10 can be seen more easily.

Figure 3:
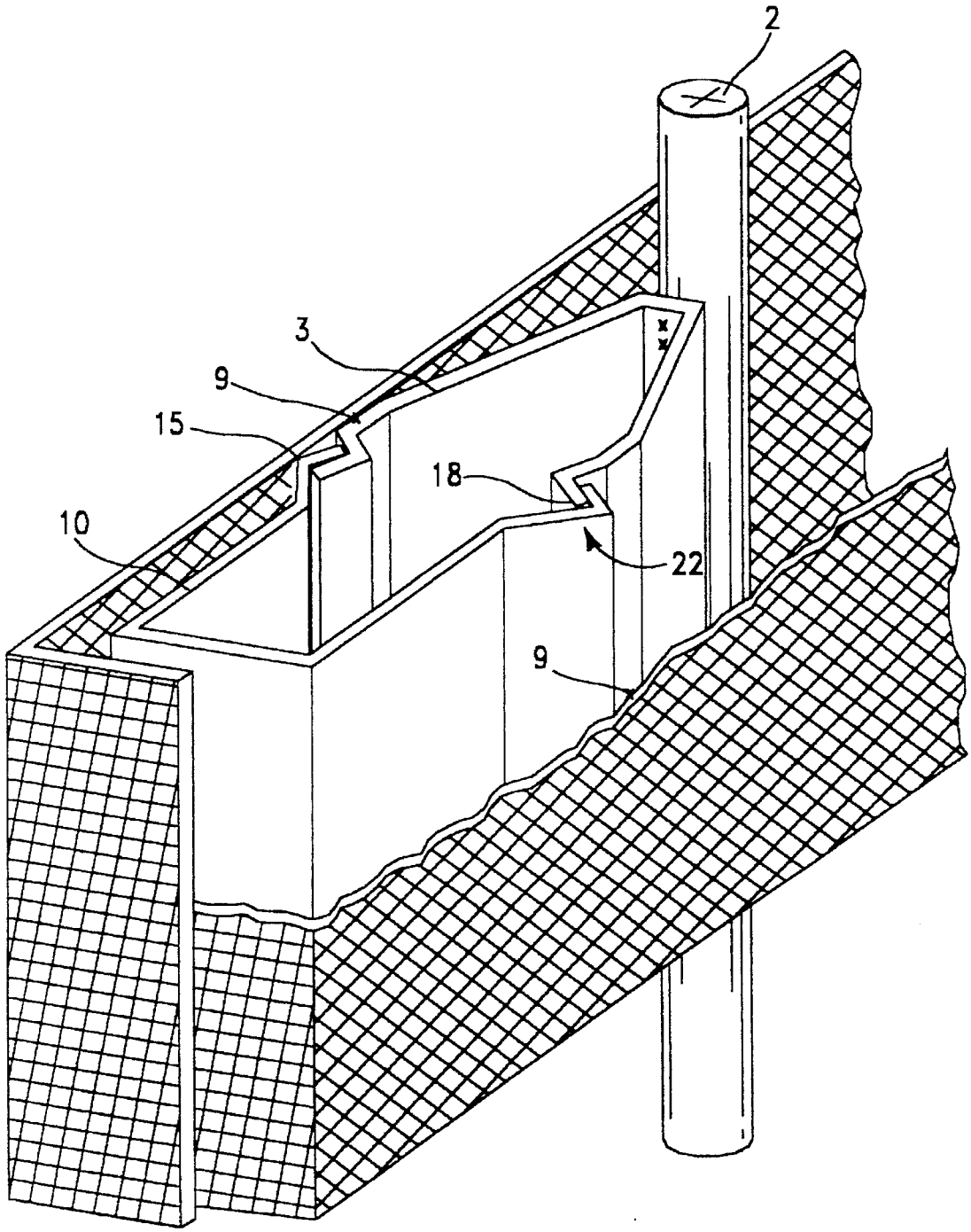
FIG. 3 is a cut-away perspective view in which the outer ends of the feed conductors are enclosed by the guide plates.

FIG. 3 shows a structure similar to that of FIG. 2, so that there is no need to provide an explanation of the parts which are the same in both. According to FIG. 3, shanks 8 of feed conductor 3, which are also in the shape of a U or V, have outward-bent distal ends 18, which engage inside V-shaped channels 22 of the distal ends of U-shaped flow guide plate 10, so that a positive connection can be achieved between the feed conductor 3 and the flow guide plates. Here the apices 15 of channels 22 are welded to the electrode structure 17 10. The rest of the design of the electrode structure is the same as that shown in FIG. 2, the feed conductor again being connected by way of weld 6 to main power feed 2 and by way of weld 9 to the outer anodic electrode structure. Because the flow guides explained previously do not extend beyond the contour of the electrode structure, it is very easy to make repairs or to replace the electrode structure in an already existing cell.

Figure 4:
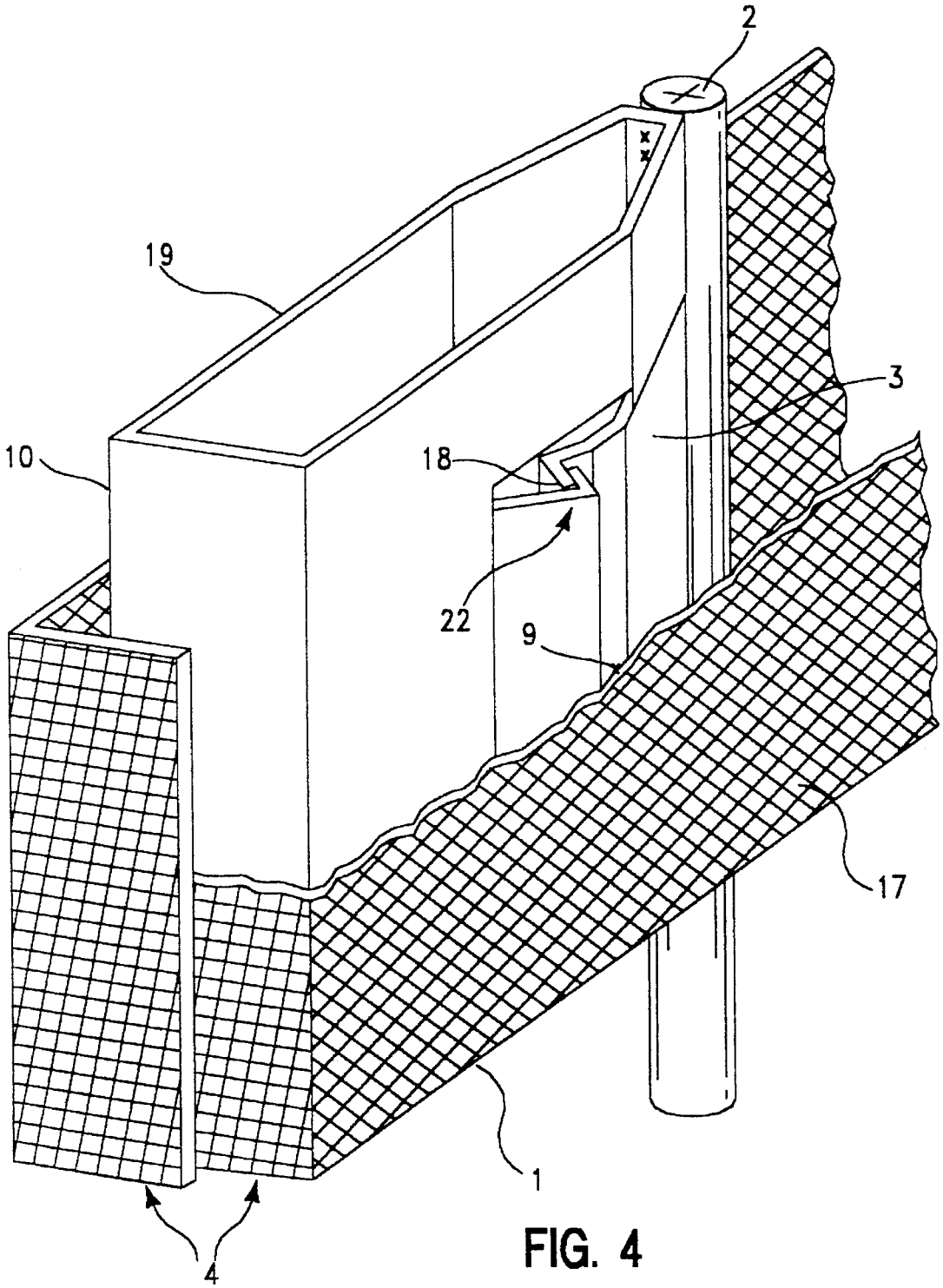
FIG. 4 shows an electrode structure with top sections on the feed conductors.

FIG. 4 shows an electrode structure which is essentially the same as that of FIG. 3, except that U-shaped flow guide plate 10' is provided with a top section 19 projecting beyond active electrode surfaces 4 to form an especially effective flow channel 16. The top section 19 also extends over the top of feed conductors 3 to complete the closed vertical flow channel projecting beyond the electrode structure.

As a result of this arrangement, the height of gas bubble-free electrolyte column in flow channel 16 is increased. This has been found to be especially advantageous, because it leads to an increase in the flow rate. The flow guide device can also be adapted without difficulty to fit already existing types of cells.

During the operation of the electrode structure in an electrolysis cell, the gas bubble-electrolyte mixture produced in the area of the active electrode surface, i.e., in the gap between active electrode surface 4 and the cathode, rises vertically upward and is, after the degassing process, guided back down again as degassed electrolyte liquid through flow channel 16. Because of the large cross section of the flow channel, even the lower areas of the active electrode surfaces are rapidly supplied with gas-free anolyte.

We claim:

1. Electrode assembly for a monopolar electrolysis cell for chlor-alkali electrolysis by the diaphragm or membrane cell process, said assembly comprising vertically oriented power feed means, a channel member welded to said feed means and comprising a pair of feed conductors extending from said feed means in vertical planes, each feed conductor having a distal end provided with detent means remote from said power feed means, a flow guide plate having a U-shaped cross section and distal ends provided with detent means which engage respective said detent means of said distal ends of said feed conductors to form a closed vertical flow channel, said flow guide plate further comprising a top section which extends over said feed conductors to extend said closed vertical channel above said channel member, and an electrode structure welded to said feed conductors, said top section of said flow guide plate extending above said electrode structure.

2. Electrode assembly as in claim 1 wherein said electrode structure is welded to said distal ends of said flow guide plate.

3. Electrode assembly as in claim 1 wherein said flow channel has a cross-sectional area in a horizontal plane and said electrode structure has a cross-sectional area in said horizontal plane, the ratio between the cross-sectional area of said flow channel and the cross-sectional area of said electrode structure being 0.3:1 to 0.6:1.

* * * * *